US006232865B1

(12) United States Patent
Zinders et al.

(10) Patent No.: US 6,232,865 B1
(45) **Date of Patent: *May 15, 2001**

(54) CORE FOR A CONTROLLABLE INDUCTOR AND A METHOD FOR PRODUCING THEROF

(75) Inventors: Gunnar Zinders, Smedjebacken; Tommy Holmgren; Björn Sandin, both of Ludvika; Stefan Valdemarsson, Västerås; Dan Elofsson; Olle Ekwall, both of Ludvika, all of (SE)

(73) Assignee: Asea Brown Boveri AB, Vasteras (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/896,495

(22) Filed: Jul. 18, 1997

(51) Int. Cl.[7] ..... H01F 27/24
(52) U.S. Cl. ..... 336/212; 336/83; 336/234
(58) Field of Search ..... 336/212, 219, 336/210, 83, 234

(56) References Cited

U.S. PATENT DOCUMENTS 3,222,626 * 12/1965 Etal .
3,451,023 * 6/1969 Etal .
3,835,430 * 9/1974 Kocsis ..... 336/83
4,092,607 * 5/1978 Robins ..... 330/8
5,138,393 * 8/1992 Okamura et al. ..... 335/297
5,430,613 * 7/1995 Hastings et al. ..... 361/760

* cited by examiner

*Primary Examiner*—Lincoln Donovan
*Assistant Examiner*—Tuyen T. Nguyen
(74) *Attorney, Agent, or Firm*—Dykema Gossett PLLC

(57) ABSTRACT

A tubular core (6) for a controllable inductor with a main winding (1) surrounding the core and a control winding (7) passing substantially axially through the core. The core (6) is capable of receiving a magnetic flux from the main winding (1) running substantially axially therethrough and having a plurality of core rings (8) stacked co-axially on top of each other and connected to a rigid unit. The core rings (8) are connected to each other forming a walled construction. The core (6) also has an inner envelope (18) with an outer cross-section that is substantially equal to the inner cross-section of the core ring walled construction. The walled construction has joints (16) between the core rings (8) in an axial direction which are overlapped by a part of the envelope (18).

9 Claims, 2 Drawing Sheets

CORE FOR A CONTROLLABLE INDUCTOR AND A METHOD FOR PRODUCING THEROF

FIELD OF THE INVENTION AND PRIOR ART

The present invention relates to a tubular core for a controllable inductor with a main winding surrounding the core and a control winding passing substantially axially through said core, said core being intended to receive a magnetic flux from said main winding running substantially axially therethrough and comprising a number of core rings stacked co-axially on top of each other and connected to a rigid unit.

Such a controllable inductor is previously known from for example the applicant's WO 94/11891. The definition of "controllable" is to be given such a wide meaning, that it also comprises the case that a control current which is constant over time passes through the control winding.

A controllable inductor of this type functions in conjunction with a capacitor as a so-called harmonic filter in connection with a high voltage station for converting direct voltage to alternating voltage, wherein its main winding is connected to the high voltage net, usually on the alternating voltage side. In such a controllable inductor the permeability of its core and thereby the inductance is adjusted with the aid of the cross-magnetization generated inside the core by usually causing direct current to run through said control winding, alternating current would however also be possible to use, wherein the inductance of the inductor may be adjusted to exactly that frequency an overtone generated in the high voltage net is having for an effective fade-out thereof while causing small energy losses in the inductor.

To keep the heat losses that arise in the core due to the magnetic flux of the main winding, at a low level, the different core rings are usually formed by a winding of a thin sheet in several turns outside each other, while such eddy current losses/unit volume are proportional to the square of the thickness of the metal that a certain flux density passes through. The core rings have thereafter been given a rigid form, usually by a vacuum pressure impregnation, producing one core at a time and thereby requiring several and expensive fixtures, usually a single fixture for each core ring, to get the rings circular and plane, which has not always been successful. The so formed rigid rings have thereafter been stacked on top of each other and glued together with the aid of an electrically insulating glue therebetween. Because of that some of these core rings have become somewhat obliquely while being cured, the gap between two successive rings might thereafter become uneven and on some places too big, which results in that at the latter use of the core in the controllable inductor the resistance against the magnetic flux will become larger at these places, causing the flux lines to run obliquely out into the air, which in turn results in oblique directions of the magnetic flux and increased eddy current losses in the core.

A further disadvantage with this known production technique is that the cores resulting from this technique will become relatively fragile for impacts and delicate to transport.

SUMMARY OF THE INVENTION

The object of the present invention is to provide a core and a method for producing a core for a controllable inductor in accordance with the preambles to the respective independent claims, which core and method to a large extent eliminate the above described problems by previous known methods and resulting cores thereof.

This object is achieved according to the invention by a method by that uncured core rings having a fixed shape are put successively against each other and aligned with each other regarding inner and outer surfaces of adjacent rings, and that thereafter successive core rings are bound to each other to a rigid construction while curing the core rings to a rigid form. Thanks to that uncured core rings having a fixed shape are put successively against each other and that these core rings are first cured in conjunction with their binding to a rigid construction, there is no need for expensive fixtures, but above all it is possible to avoid that the rings warp and it is possible to obtain a small but uniformly wide gap between two successive rings, so that the above mentioned problem with local oblique directions of flux lines and thereof resulting eddy current losses will be solved.

According to a preferred embodiment of the invention the uncured core rings are put against each other by putting them on top of each other. By such putting of the core rings on top of each other the gravity may be utilized in order to facilitate the alignment of the core rings to each other.

According to another preferred embodiment of the invention uncured core rings having a fixed shape are thread on the outside of an inner envelope with substantially equal outer cross section form as the inner cross section form of said cores in such a way that said joints between successive core rings are overlapped in axial direction of a part of said envelope continuously extending in this direction on each side of the joint in question, and that thereafter successive core rings and said core rings and said envelope are bound to each other to a rigid walled construction while curing said core rings to a rigid form. Thanks to that the inner envelope is utilized for supporting the core rings in place during the binding itself of the core rings to each other and to the envelope, these core rings may be cured to rigid core rings firstly at the binding of said core rings to each other forming a rigid core. In this way there is no need for expensive fixtures, but above all it is possible to avoid that the rings warp and it is possible to obtain a small but evenly wide gap between two successive rings, so that the above mentioned problem with concentrations of flux lines and thereof resulting heat losses will be solved. Thanks to that the joints between successive core rings will be overlapped in axial direction of said envelope and that this envelope will be bound to the core rings also a very strong, walled core will be obtained, said core being stable and may easily be handled and transported without risk for deformations thereof. With "uncured" means that the core rings have not adopted any rigid form when they are thread outside an inner envelope. The words "the core rings are thread on the outside of an inner envelope" are of course also comprising the case that a relative movement between these rings takes place so that it is the envelope that may be regarded to be pushed into the core rings. The curing of the core rings may take place by them being imparted a rigid form by curing of some binding agent or similar penetrated thereinto, possibly by way of an increased temperature, or simply by way of providing each core ring with a rigid form by connecting it both to the envelope as well as to an adjacent core ring.

According to another preferred embodiment of the invention the method comprises the step of carrying out said binding on the surface by a binding agent over substantially the complete surfaces in question adjacent to each other of the core rings and the envelope. In this way a very strong walled construction will be obtained and it is easy to handle and to transport.

According to another preferred embodiment of the invention the core rings are produced by winding a metal sheet in several turns on top of each other, said sheet being applied with an insulating layer, said core having an external and internal cylindrical form substantially conically tapering against the two outer ends, and the core rings having a substantially conical form are produced by cutting said metal sheet obliquely across the winding direction in connection with the winding, so that the width of the sheet decreases successively. In this way core rings for reducing eddy current losses at the ends of the core will easily be produced in the requisite form without any requirements of subsequent working, applying of specially produced conical outer casings or similar.

According to another preferred embodiment of the invention an electrically insulating binding agent is applied between the envelope and the core rings as well as between successive core rings and this binding agent is cured with core rings and the envelope mounted to substantially one half of the core to be produced. The specific producing of one core half at a time has shown to be effective and to enable a high production accuracy.

According to another preferred embodiment of the invention such a half may be formed by accomplishing of the following successive steps: a core ring is put on an even support, an envelope part is axially inserted inside said core ring to a position supported by distance portions in order to keep said envelope part at a distance above said support, a second core ring is axially pushed onto said envelope part outside thereof to abut on top of said first core ring, this forming being continued while observing that each joint between successive core rings is overlapped by one envelope part extending continuously on each side thereof, and successive core rings and said envelope and said core rings thereafter at the same time being bound to each other. In this way a core half may be obtained with a very high accuracy, i.e. thin uniform gaps will be formed between successive core rings and two so formed core halves may then easily be connected to each other by axially inserting an envelope part in respective core half towards said envelope part supported on the distance portions at the stacking and applying a binding agent between this envelope part and the core ring adjacent thereto of respective core half as well as the two core rings resulting against each other of the different core halves.

According to another preferred embodiment of the invention an insulating impregnating liquor is inserted in a vacuum pressure impregnation step as an insulating binding agent between the envelope and the core rings as well as between successive core rings for curing thereof to a rigid unit. In this way it is possible to obtain a very stable unit without any risk for appearance of obliqueness during the curing procedure. Besides, this impregnating liquor may penetrate between the winding turns and bind them tightly to each other in the case of core rings produced by a wound thin metal sheet.

According to another preferred embodiment of the invention thin distance portions of electrically insulating material are inserted between successive core rings to form a spacing therebetween, in which spacing a medium interconnecting said core rings after curing thereof will be inserted. In this way it is easily ensured both that successive core rings get insulated from each other by means of a thin gap and that the medium needed for binding the core rings to each other effectively may penetrate into between the core rings.

According to another preferred embodiment of the invention thin distance portions of electrically insulating material are inserted between said core rings and said envelope to form a spacing therebetween, in which spacing thereafter a medium interconnecting said core rings and the envelope is inserted. The advantages of this embodiment are the same as of the previous embodiment, and especially advantageous is to combine these two embodiments and then especially while utilizing an above mentioned vacuum pressure impregnation step for the binding.

A tubular core according to the invention is characterized by that it comprises an inner envelope with substantially the same outer cross section form as the inner cross section form of the core rings and that the envelope and the core rings as well as successive core rings are connected to each other to a walled construction with the joints between respective core rings overlapped in axial direction by a continuously extending part of the envelope in this direction on each side of the respective joints. The advantages with such a core is apparent from the discussion of the second preferred embodiment in due course of the method according to the invention.

Further advantages and advantageous characteristics of the invention will be apparent from the following description and the other depending claims.

BRIEF DESCRIPTION OF THE DRAWINGS

With reference to the appended drawings, below follows a description of a preferred embodiment of the invention cited as an example. In the drawings.

DETAILED DESCRIPTION OF A PREFERRED EMBODIMENT OF THE INVENTION

Figure 1:
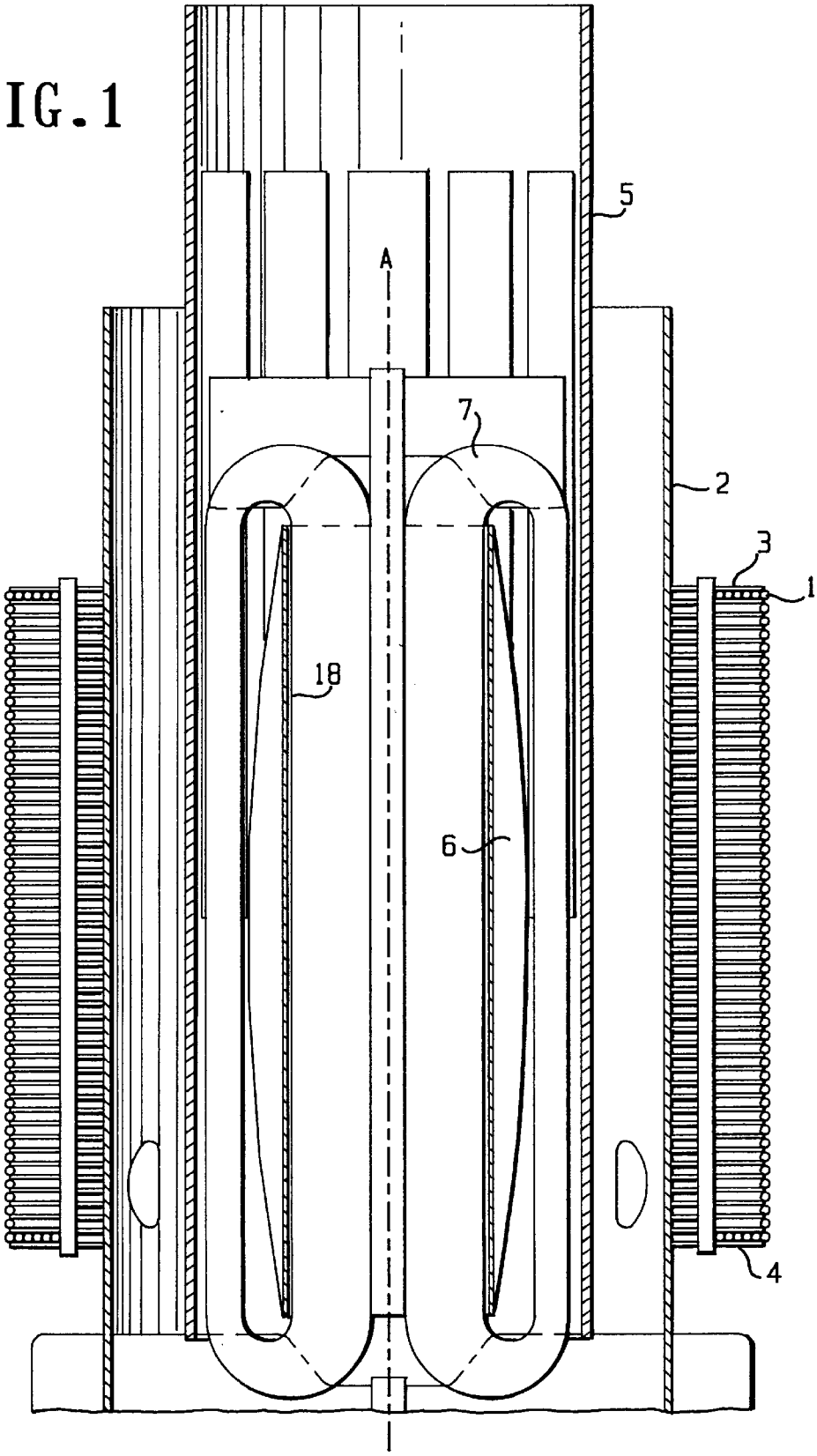
FIG. 1 is a partly cut, simplified view illustrating the general construction of a controllable inductor.

The general construction of a controllable inductor, in which a tubular core according to the invention is intended to be utilized, is illustrated in FIG. 1. This controllable inductor has the following general construction. It has a main winding 1 intended to be connected to a high voltage net and which main winding is wound in layers at a distance outside a cylinder 2 of electrically insulating material. The main winding 1 has one end 3 being on the same voltage potential as the high voltage net, said voltage dropping in direction towards the opposite lower end 4 in FIG. 2, said end 4 being on ground potential. A cylinder 5 of electrically insulating material is arranged inside and running coaxially to the cylinder 2. In the room defined by the cylinder 5 a core 6 is located and running co-axially against the same, the construction and method for production of said core being object for the present invention and which core having a partly conical form at its ends, which form is to reduce the eddy current losses caused by the alternating longitudinal magnetic flux generated in the core because of the alternating high voltage in the main winding 5. This phenomenon is described in the applicant's WO 94/11891. The control winding 7 is connectable to a direct current source for transmitting a direct current therethrough, which will generate a cross-running magnetic flux tangentially against the main flux in the core and in that way decrease its permeability for the longitudinal magnetic flux from the main winding while the hysteresis losses in the core are almost eliminated. It would, however, also be possible to utilize an alternating current as control current in some cases. By increasing the control current it is possible to decrease the permeability of the core and thereby decreasing the inductance of the inductor. A lower permeability of the core is also enabling a larger storage capacity of energy per unit volume in the core, so that the inductor may be made more compact.

Figure 2:
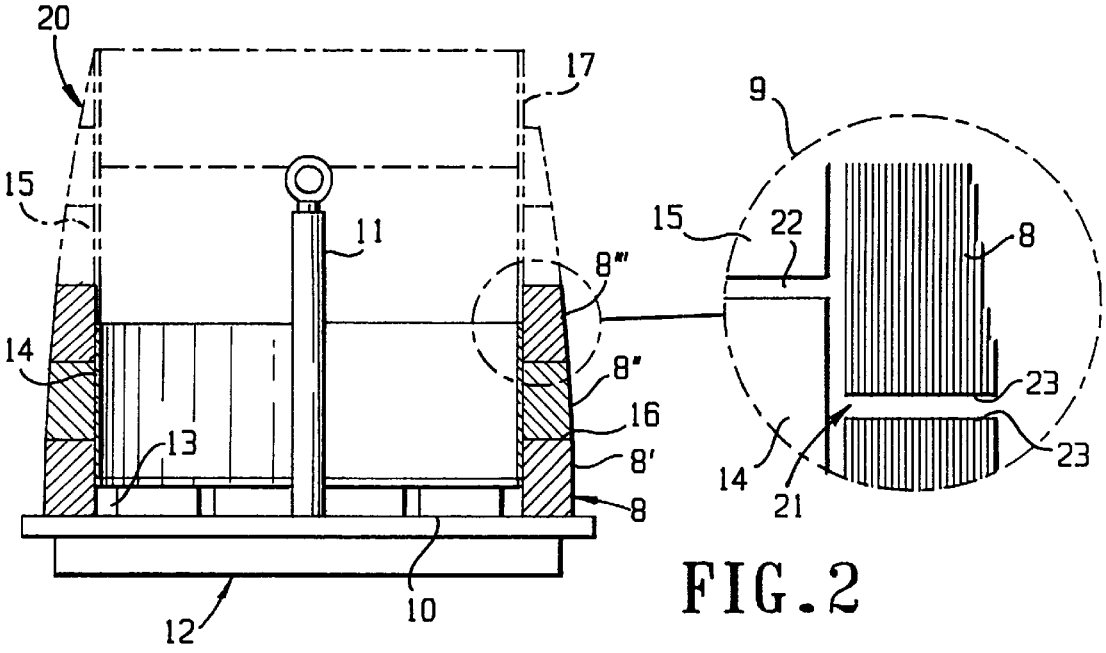
FIG. 2 is a simplified, partly cut view illustrating how one core half may be built up according to a preferred embodiment of the invention.
Figure 3:
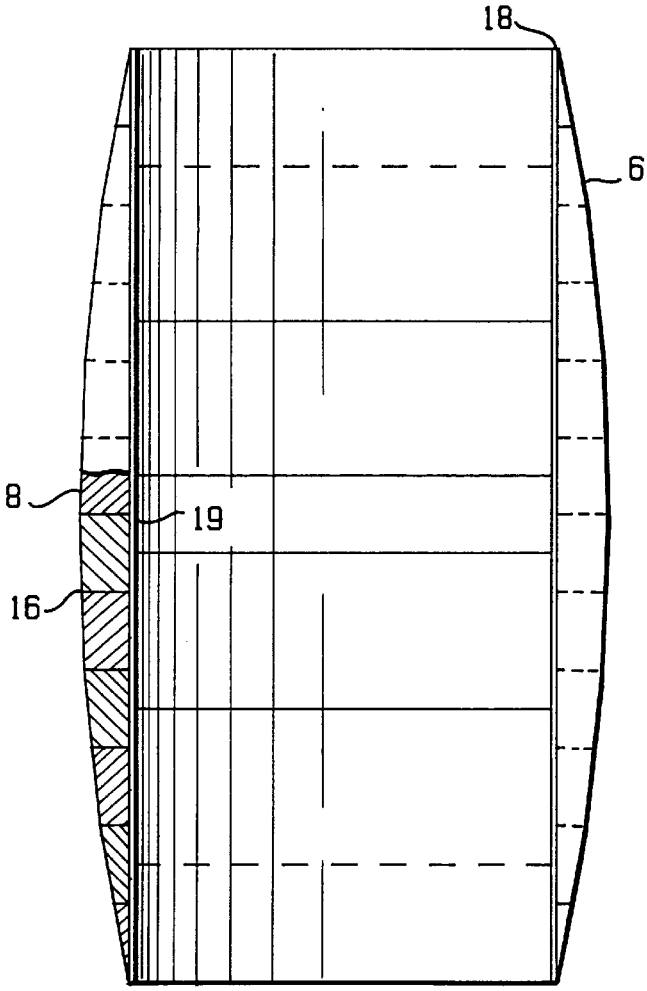
FIG. 3 is a simplified, partly cut view of a tubular core according to a preferred embodiment of the invention.

The construction of the core and the method for producing the core will now be explained with reference to FIGS. 2 and 3. The core is built up from a number of core rings 8, which in turn are formed by means of that a number of turns of a metal sheet has been wound closely outside each other, said metal sheet being applied with a thin electrically insulating layer and preferably consisting of iron, so-called electric sheet. This construction is indicated very schematicly in the enlarged ring 9 in FIG. 2. In practice there might be several of hundreds of turns of winding for one core ring. Most core rings, possibly except for the core ring 8' located closest to the centre of the core, have a somewhat tapering form in axial direction as seen towards its own end, to give the completed core a substantially partly conical outer form, while it has a substantially cylindrical internal form. In order to obtain this, the sheet may in connection with the winding be cut in a pair of roller scissors that is directed obliquely across the sheet so that the width of the sheet successively decreases. The way this is carried out is very schematically indicated in the enlarged ring 9. It is of uttermost importance that the successive turns of winding are isolated from each other, so that the respective core ring will be built up from several thin layers. This is due to that the power dissipation per unit volume through a magnetic flux passing through a metal object is proportional to the square of the thickness of the object across the flux direction, making it important to use a plurality of sheets isolated from each other in this way. The dividing of the core into a number of core rings also has the object to decrease the possible paths that eddy currents generated because of the radial component of said magnetic fluxes may get inside the core and thereby reducing the obtained power dissipation due to the eddy current. Another advantage with dividing the core in several rings is that these rings thereby may be handled manually and that there is no need for an expensive winding and lifting equipment for this purpose.

The method for producing the core will take place in the following way. After being wound, a first core ring 8' will be placed on a support 10, which is provided by a palette 12 provided with a lifting bar 11. Thereafter distance portions 13 provided with release agents, for example steel capsulated with teflon, are distributed on the support 10 of the palette and on a first envelope part 14, said envelope part also being formed by several turns of a thin metal sheet wound outside each other, said sheet being applied an electrically insulating layer and guided axially into the core ring 8' to a location on top of the distance portions 13. The envelope part 14 is considerably thinner than the core rings and can typically be formed by about 20 turns of winding of sheet. The outer form of the envelope part 14 is substantially corresponding the inner form of the core ring 8. Some thin distance portions of an electrically insulating material, not shown in the drawings, are preferably distributed circumferencially uniformly and inserted between the core ring and the envelope portion to allow insertion of an impregnating liquor or other binding agent therebetween in a later step of the method, but it is also possible that a connection of the core ring to the envelope part takes place by means of heating or solidification of a possible glue layer or similar that the parts are provided with.

Thereafter thin distance portions of electrically insulating material are put on top of the lower core ring 8', said material in the present case being so-called Nomex strips with a thickness of for example about 0,1 mm, and a second core ring 8' is put outside the first envelope part 14 for abutting onto said distance portions above the first core ring 8' while forming a very thin and surrounding and radially uniform gap between the core rings. When this has taken place a third core ring 8''' is applied correspondingly and thin distance portions may possibly be inserted between the core rings and the envelope portion 14. Thereafter thin distance portions, like the mentioned Nomex strips, are put on the upper edge of the first envelope part 14 and the second envelope part 15 produced correspondingly by a wound metal sheet, is placed onto the first part. In this way the building with core rings and envelope parts continues, and all the time it is taken care of that a joint 16 between two successive core rings in axial direction is overlapped by a part of the envelope continuously extending in this direction on each side of the joint. In the present case each envelope part 2 is overlapping such joints, except for the third envelope part 17 located at an end, but it is in praxis possible to use any combinations. For example each envelope part could be overlapping only one joint or more than two joints, and it would also be theoretically possible for the core rings to have a longer axial extension than the envelope parts. The envelope formed by the envelope parts could also have envelope parts with a very varying extension in axial direction. The third envelope part 17 is formed in a way that the last core ring ends on the same level.

When a core half 20 has been completed in this way, the palette 12 is lifted into an oven for vacuum pressure impregnation under an enhanced temperature, and impregnating liquor penetrates into the spacings between successive core rings at said joints 16 and preferably also between the envelope parts and the core rings and also to some extent into between the turns of winding formed by the envelope parts and the core rings. Thereby the envelope parts and the core rings will effectively keep each other on defined, desired places without any stresses, and the core half resulting from the cooling and the curing will have small and uniform distances between successive core rings. These core rings are thus cured to a rigid form firstly in connection with the connection of these core rings with other core halves and envelope parts to a rigid core half. The walled construction obtained by the connection of the core rings results in a very stable form of the resulting core half, which connection takes place both directly with an adjacent core ring and indirectly via the common connection with the inner envelope, the stable form facilitating handling and transporting of the later on finished core.

When two rigid core halves are formed in this way a central envelope part 19 is guided into one of the core halves and glued with room-curing glue at the core ring 8' in question and the adjacent first envelope part 14. The central envelope part 19 has an axial length, substantially corresponding to twice the length of the distance portions 13. Thereafter the two core halves are docked to each other by inserting the central envelope part 19 fixed in one of the core halves into the other core half and binding takes place with a room-curing glue. After the curing the core is completed. For a case with typical measures a core ring 8' has a thickness of 65 mm, a height of 100 mm and an inner diameter of 550 mm, the core ring being wound by a sheet with a thickness of 0,23 millimetre. The envelope parts may have a thickness of 10 mm and the core a length of 1200 mm.

For applying of the control winding coils on their designated places with one part extending substantially axially through the core, a piece of the core may be cut away by means of watercutting, so that the core receives an opening from one of the ends to the other end, said opening running axially, for inserting the control winding coils therethrough. Such a watercutting may cause a shortcircuit of the sheets comprised in the core by means of the metal floating out at the cutting stand, but this may be fixed by means of etching the surface, so that the contact between the sheets is eliminated before the core piece cut away will be put in place again with a suitable binding agent.

By means of the totally new way of using an internal envelope for building a core for a controllable inductor the curing of the different core rings may take place firstly at the binding thereof to a rigid unit while obtaining thin and uniform gaps between adjacent core rings, so that local oblique directions of the flux with an increased power dissipation at these gaps may be avoided. The envelope will thereby also work as an integrated part of the core itself and the envelope is preferably divided into several axially successive parts, insulated from each other to limit the eddy current losses therein. Besides, the core will be very stable thanks to the walled construction that is obtained by means of using an envelope extending continuously past the joints between successive core rings.

The invention is of course not in any way limited to the above described preferred embodiment, but a number of possibilities to modifications thereof should apparent to a man skilled in the art, without departing from the scope of the invention.

The definition "stacked on top of" in the claims is intended to also comprise stacking in the meaning that something is put next to something else, while it should be regarded to be equivalent to putting core rings and envelope rings on top of each other and letting the gravity co-operate with possible distance portions by instead pushing them against each other from the side and hold them against the distance pieces by means of some stretching device or similar. Despite this it should in most cases be most advantageous to utilize the gravity for this purpose.

The definition "binding agent" in the claims is besides conventional binding agents also intended to comprise something without any adhesive effect, but that can bind something by means of causing it to melt and thereafter solidify.

It would of course be possible to build up the whole core at once before the different parts are bound rigidly to each other, and it would also be possible to bind only one or a few envelope parts at a time with one or several core rings, as long as it is taken care of that the joints between successive core rings will be overlapped in axial direction of a continuously extending envelope part in this direction on each side of the joint.

It may of course naturally not be regarded to escape from the scope of the invention if said overlapping criteria should be fulfilled for all joints except for one single joints or a few joints located at one location on the core, where it possibly could be allowed while considering the requirements for stability and heat efficiency reduction.

The envelope may be built up from one single envelope part.

As indicated in the independent method claim it is possible to produce a core according to the invention without using any envelope. The strength at transports and handling by a core obtained in this way may instead for using of an envelope therefore take place while contraction of the core by means of an end cross. This method also requires utilizing of some sort of controlling of the core rings relative each other while bringing them towards each other and possibly also during the curing itself.

What is claimed is:

1. A tubular core comprising:

a central axis for a controllable inductor with a main winding surrounding the core and a control winding passing axially through said core, said core for receiving a magnetic flux from said main winding and extending axially therethrough comprising a hollow envelope that is cylindrical in shape and has a cylindrical outer wall; and a number of magnetically permeable core rings, each of said rings having a cylindrical inner wall and annular ends located opposite one another;

said core rings being stacked co-axially on top of each other and having a space between each of said stacked rings, said envelope and adjacent ends of the core rings being disposed in confronting abutting contact;

said envelope and said stacked core rings being connected to each other forming a wall with the annular ends forming joints between the core rings in the axial direction;

said joints being overlapped by a portion of said envelope continuously extending axially across each joint; and a cured, electrically insulating layer formed of a binding agent is arranged in said spacing between said stacked core rings.

2. A core according to claim 1, where said envelope is formed by a plurality of cylindrical sections stacked on top of each other.

3. A core according to claim 1, wherein said envelope is formed of a thin magnetic band wound in layers with an insulating layer between each said layer of thin magnetic band.

4. A core according to claim 1, wherein each of said core rings is formed of a thin magnetic band wound in layers with an insulating layer between each said layer of thin insulating band.

5. A core according to claim 1, wherein a cured, electrically insulating layer formed of a binding agent is arranged outside said envelope between said envelope and one of said core rings.

6. A core according to claim 2, wherein a cured, electrically insulating binding agent is arranged in the space between said stacked cylindrical sections of said envelope.

7. A core according to claim 5, wherein said binding agent comprises a vacuum formed cured impregnating liquor.

8. A core according to claim 1, wherein the core is formed by two halves each having a free end and an inner end portion formed of the annular ends of each of a pair of adjacent said core rings, each of said halves having been pushed together and with each of said core rings adjacent each free end protruding axially past the envelope, and a section of said envelope inserted into one of said core rings adjacent said inner end portion and extending halfway into each of said core rings, said envelope section being connected to the one of said core rings adjacent each inner end of each of the halves for interconnecting the halves to form the core as a unit.

9. A core according to claim 1, wherein the free ends of the core have a conical shape.

* * * * *